United States Patent [19]

Riggs et al.

[11] 4,343,356

[45] Aug. 10, 1982

[54] METHOD AND APPARATUS FOR TREATING SUBSURFACE BOREHOLES

[75] Inventors: Emmet D. Riggs; Eugene R. Brownscombe; James R. Bilhartz, all of Dallas, Tex.

[73] Assignee: Sonics International, Inc., Dallas, Tex.

[21] Appl. No.: 888,352

[22] Filed: Mar. 20, 1978

Related U.S. Application Data

[62] Division of Ser. No. 295,694, Oct. 6, 1972, abandoned.

[51] Int. Cl.[3] ..... E21B 36/04; E21B 37/00

[52] U.S. Cl. ..... 166/60; 166/248; 166/311; 166/63; 166/65 R

[58] Field of Search ..... 166/60, 63, 248, 311, 166/297, 177; 175/16; 313/217; 314/59

[56] References Cited

U.S. PATENT DOCUMENTS

| | | | |
|---|---|---|---|
| 549,132 | 11/1895 | Jehl | 314/59 X |
| 2,481,887 | 12/1949 | Smits | 314/59 |
| 3,169,577 | 2/1965 | Sarapuu | 166/248 |
| 3,180,418 | 8/1965 | MacLeod | 166/177 X |
| 3,488,546 | 1/1970 | Paquette | 313/217 X |
| 3,530,936 | 9/1970 | Gunderson | 166/248 |
| 3,621,916 | 11/1971 | Smith, Jr. | 166/297 |
| 3,679,007 | 7/1972 | O'Hare | 175/16 |

*Primary Examiner*—Price C. Faw, Jr.
*Attorney, Agent, or Firm*—Sigalos & Levine

[57] ABSTRACT

A method and apparatus for cleaning openings in a borehole casing, slotted liner, screen or the like, cleaning subsurface earth formations and/or stimulating the flow of fluids through subsurface earth formations surrounding a borehole in which a plasma is generated adjacent the area to be treated by the gasification and ionization of a gasifiable and ionizable material, such as, water, petroleum or similar fluids and/or solids, such as, a consumable metal wire, thereby creating an intense shock wave which passes into or through the material being treated. The plasma region is created by any means adapted to gasify and ionize the gasifiable and ionizable material, such as, a high voltage, high current electrical discharge of short duration.

15 Claims, 10 Drawing Figures

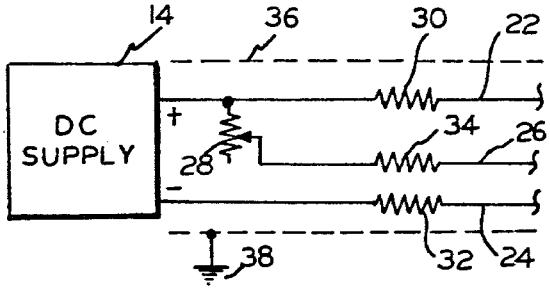
FIG. 3
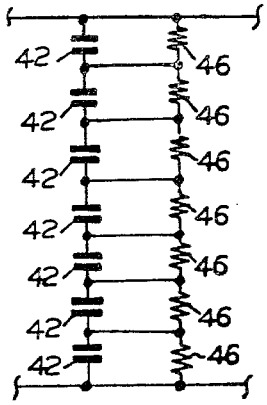
FIG. 4
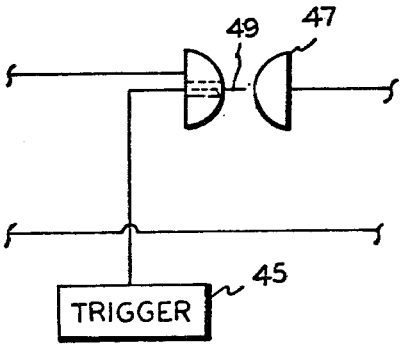
FIG. 5
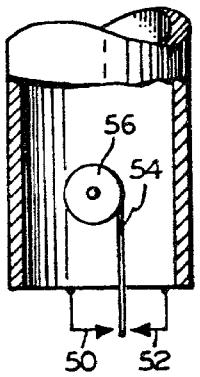
FIG. 6
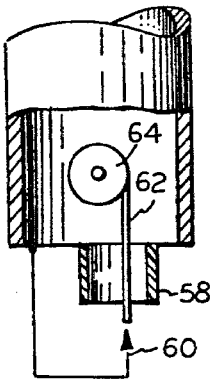
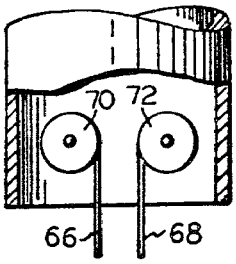
FIG. 8

METHOD AND APPARATUS FOR TREATING SUBSURFACE BOREHOLES

This application is a divisional application of application Ser. No. 295,694, filed Oct. 6, 1972, entitled METHOD AND APPARATUS FOR TREATING SUBSURFACE BOREHOLES, now abandoned.

BACKGROUND OF THE INVENTION

In the art of petroleum production, a borehole is drilled into the earth through the oil or gas producing subsurface formation or, for some purposes, through a water bearing formation or a formation into which water or gas is to be injected. Completion of a well may be carried out in a number of ways dependent upon the nature of the formation of interest. For example, where a relatively stable, consolidated earth formation is penetrated, oil may be produced or fluids injected through an open hole. On the other hand, where the formation itself or formations above the formation of interest have a tendency to disintegrate and/or cave into the hole, a casing is normally set in the well through the formation of interest and the casing is then perforated adjacent the formation of interest. Finally, where the formation of interest is a substantially unconsolidated sand, which has a tendency to flow into the well along with the produced fluids, a slotted liner or screen is hung inside a casing or oil string opposite the producing zone. The oil string may have been either cemented through the section and perforated or set on top of the section with the liner hanging below the casing and through the formation. In some instances, the well bore may be slightly enlarged in the formation of interest, packed with gravel and then have a slotted liner or screen set in the gravel pack. In any event, after a period of production of fluids or the injection of fluids, there is a tendency for the openings in the casing or liner and/or the pores of the formation itself to become plugged with various types of residues. For example, paraffin, asphalts and other gummy residues of petroleum origin often cause plugging problems. While such deposits are not in and of themselves a serious problem, because of their relatively soft nature and the fact that they can be dissolved rather readily with certain chemicals, these materials of petroleum origin either together with chemicals from water, normally produced with the oil, such as, calcium sulfate and the like, or such chemicals themselves have a tendency to form extremely hard deposits, particularly, in the slots of a liner, the openings of a screen or the perforations of a well casing. These hard materials adhere to the casing, liner or screen, restricting the openings and, thus, seriously reducing or completely preventing the flow of fluids through the openings. These hard encrustations are extremely difficult to dissolve by known chemical means or to dislodge by known mechanical means. Consequently, it is often necessary to rework the well and replace the liner or reperforate the casing. Such tactics are, of course, both time-consuming and expensive.

Chemical treatments, such as, treatments with acids, surface active agents and the like have been utilized in order to clean out plugged openings in the casing, liner or screen. However, such techniques, while less expensive than a complete workover, are substantially less effective, since they are incapable, in most cases, of dissolving significant amounts of the plugging materials.

Numerous techniques, which can be classified as mechanical techniques, have also been suggested for the purpose of cleaning openings in the casing, liner or screen. These include applying heat by an electrical heater, the ignition of gas in an electric arc, etc. However, the heat generated in these instances is generally insufficient to have any real effect even on materials, such as, paraffin, asphalt, etc. which can be liquified by heat. The primary difficulty, however, is that the well is normally full of liquids, under a high pressure and the heat of such heating means is rapidly dissipated in the well fluid before it has an opportunity to have any real effect on deposits in the casing or liner.

It has also been proposed to create shock waves adjacent the formation to thus dislodge such deposits. One means which has been proposed is the ignition of a combustible gas or gasses by means of an electric arc with the thought that sufficient heat and/or a mechanical shock wave will be created. However, such a source of heat and/or shock waves is generally of too low an intensity to have any appreciable effect in cleaning the openings in the casing, liner or screen. To date, no practical means for overcoming these problems has been suggested.

Another means of mechanically cleaning openings in a casing, liner or screen which has received some attention in recent years is the creation of ultrasonic vibrations in the well bore. The interest in this technique stems from the fact that ultrasonic irradiation can create cavitation in a liquid medium. Specifically, the ultrasonic irradiation causes the formation of local cavities in a liquid, as a result of the reduction of total pressure. When these cavities collapse, they produce very large impulse pressures. However, in order to accomplish these results, a very high source of power must be utilized. While numerous efforts have been made to develop high power, ultrasonic generators, only limited success has been achieved and this success has not been sufficient to adequately clean well screens or liners, even under ideal laboratory conditions. Moreover, under normal hydrostatic pressures encountered in a well fluid, i.e. 200 psig, it is difficult, if not impossible, to achieve cavitation with presently available ultrasonic transducers. Here again, no practical solutions have been found.

It is also desirable, either on newly drilled wells or on wells that have been utilized for some time for production or for water or gas injection, to resort to various well stimulation techniques to remove plugging deposits from the pores of the formation surrounding the well bore or to actually enlarge the flow channels through the formation of interest. It is highly desirable to maintain the formation immediately surrounding the well in a highly permeable condition since the formation immediately adjacent the well bore has a profound effect on the ability to produce fluids from the formation or inject fluids into the formation. This follows from the obvious fact that fluids are being produced from an extremely large volume of the formation at some distance from the well bore and these fluids then must be funnelled through or produced through the very limited volume of formation surrounding the well bore. Thus, plugging of the area immediately surrounding the well bore has a drastic effect upon the resistance to flow of the fluids. All of the above-mentioned techniques for cleaning casing perforations, liners, screens and the like have also been utilized with some success for removing plugging deposits from earth formations and/or increasing the permeability of the formation. For example, conventional acidizing, mud acid treatments, jet acidization and the use of surface active agents have been utilized. However, in this instance, the treatment is generally no more successful than the treatment to clean out the openings in the casing or liner. Acidization has also been utilized to actually increase the permeability of a formation of interest. However, a more effective technique for increasing permeability has been that of hydraulic fracturing. In this instance, a relatively viscous fluid is pumped into the formation of interest at a pressure and for a time sufficient to actually fracture the formation. Thereafter, sand is carried into the fractures by means of an appropriate carrier fluid and the pressure is then released to permit the fracture to partially close and hold the sand in place. While this technique has proven to be highly successful in improving formation permeability, it is a relatively costly operation and it is generally not utilized where only plugging is the cause of restricted flow or where permeability improvement is necessary only in a very limited section of the formation surrounding the well bore.

It is therefore an object of the present invention to provide an improved method and apparatus for treating boreholes extending into the earth. Another and further object of the present invention is to provide an improved method and apparatus for cleaning openings in casings, liners, screens, etc. positioned adjacent a subsurface borehole. Yet another object of the present invention is to provide an improved method and apparatus for increasing the production of fluids from a subsurface earth formation or increasing the injectivity of fluids into such formations. A still further object of the present invention is to provide an improved method and apparatus for increasing the effectiveness of chemical treating agents utilized in cleaning openings in casings, liners, screens, etc. positioned adjacent a subsurface earth formation. A further object of the present invention is to provide an improved method and apparatus for increasing the effectiveness of chemicals utilized in the treatment of subsurface earth formations to increase the permeability thereof.

A still further object of the present invention is to provide an improved method and apparatus for fracturing subsurface earth formations. Another and further object of the present invention is to provide an improved method and apparatus for use in conjunction with the hydraulic fracturing of subsurface earth formations to improve the permeability thereof. These and other objects and advantages of the present invention will be apparent from the following detailed description when read in conjunction with the drawings wherein:

FIG. 3 is an electrical schematic of a suitable decoupling means for use in the system of FIG. 2;

FIG. 4 is an electrical schematic of a suitable storage means for use in the system of FIG. 2;

FIG. 5 is an electrical representation of a switch means and transducer for use in the system of FIG. 2;

FIG. 6, 7 and 8 are mechanical representations of spark gap transducer means for use in the system of FIG. 2;

SUMMARY OF THE INVENTION

Figure 1:
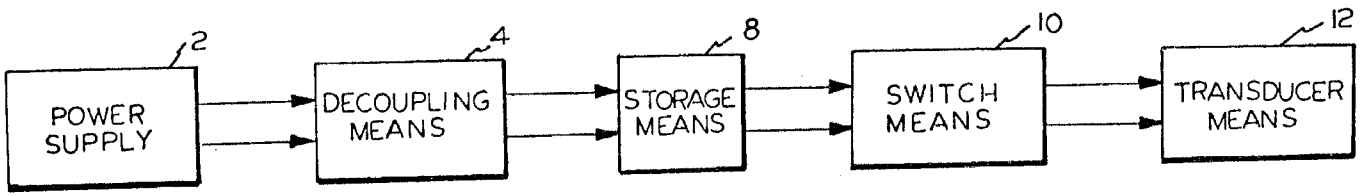
FIG. 1 is a simplified, electrical block diagram of a system for carrying out the method of the present invention.

A method for treating a well adjacent a subsurface earth formation, comprising, disposing a source of high energy in the well adjacent the formation to be treated and suddenly releasing the energy to create a plasma by gasification and ionization of a gasifiable and ionizable medium adjacent the formation to be treated. A suitable apparatus for carrying out the method includes a high voltage, high current source of electrical energy adapted to be disposed in a well, discharge means operatively coupled to the source of electrical energy and adapted to discharge the source of electrical energy in a period of time sufficiently short to create a plasma in a gasifiable and ionizable medium, and arc means operatively coupled to the discharge means and adapted to contact the gasifiable and ionizable medium.

DETAILED DESCRIPTION OF THE INVENTION

As defined by "The International Dictionary of Physics and Electronics", D. Van Nostrand Company, 1956, "plasma" is defined as "The region in a gas discharge which contains very nearly equal numbers of positive ions and electrons, and hence is nearly neutral". Alternatively, "The Condensed Chemical Dictionary", 6th. Edition, Reinhold, 1956, defines "plasma" as "The mixture of electrons and gaseous ions (electrically charged atoms or parts of atoms), with or without neutral atoms, which forms when any substance is heated to very high temperatures. A plasma may be formed by an electric arc of sufficient power, by sonic shock waves, or other very sudden releases of very large quantities of energy, as in nuclear processes of fission and fusion." For example, when an electrically initiated spark takes place under water, such as, brine, the rapid transfer of a large amount of energy into a small volume of the spark channel raises the temperature of the gasifiable and ionizable medium and tends to make it expand. The enveloping medium opposes this expansion, with the amount of opposition being dependent on the medium density and relatively independent of hydrostatic pressure. This resistance of the expansion results in the development of high pressures in the spark channel. Therefore, the maximum possible power is supplied to the spark channel in the shortest period of time (while the volume of the channel is still small). This calls for a maximum rate of current rise together with high spark resistance. The high spark resistance is, of course, caused by high plasma pressure and by low inductance and resistance in the initiating circuit. A high efficiency energy transfer then takes place. When the plasma is created, various types of particles exist in the plasma, for example, where water is the gasifiable and ionizable medium, water molecules, oxygen molecules, hydrogen molecules, ozone molecules, oxygen atoms in all degress of excitation and ionization, hydrogen atoms in all degrees of excitation and ionization (and singly ionized), metal atoms (from the electrodes or other metals present) in all degrees of excitation and ionization, hydroxyl groups and negative hydrogen ions. The atoms, etc. in the plasma will generally originate from the water rather than any metals present. At the moment of discharge, when the plasma is formed in the gasifiable and ionizable medium, energy is almost totally contained for a brief period, probably about 5 microseconds. Thereafter, the energy is removed or dissipated from the spark channel by radiation, mechanical work to generate a shock wave, and thermal conduction to the surrounding medium, the shock wave being the major portion of the work.

Based on the above, where the plasma and consequent shock wave is produced from a single electrical discharge, the magnitude of the shock wave is a function of:

1. The voltage applied to the spark gap,
2. The impedance in the discharge circuit,
3. The capacity of the storage means used to store electrical energy prior to discharge,
4. The size, configuration and spacing of the spark gap electrodes,
5. The medium into which the discharge takes place and
6. The shape of the structure supporting the spark gap electrodes.

It is to be recognized here that the creation of a plasma and the consequent power of the shock wave differ radically from the relatively low power shockwaves which can be generated by an ultrasonic generator, for example, 3 kw (standard commercial ultrasonic generator) as opposed to powers in the megawatt range produced by the plasma, for example, 51,000 kw. Similarly, the power or rate of energy release utilized in creating a plasma differs radically from the power or rate of energy release as a result of the ignition of a combustible gas by a spark. The time for release of the energy for a plasma is measured in microseconds while the time for release of the energy for an exploding gas is measured in milliseconds. Obviously, the effectiveness and efficiency of the energy transfer is greater the faster the energy is released.

The creation of a plasma in a well bore adjacent the formation to be treated has numerous distinct advantages over prior art techniques of like character. It has been determined by tests that the resultant high intensity shock wave from the creation of the plasma can be generated in and transmitted through liquids in a borehole under high hydrostatic pressures. It has also been observed that the initial shock wave is followed by a rarifaction phase. The initial shock has been found to cause material within the slotted liner or the like to be dislodged and the rarifaction phase of the wave then forces the loosened or dislodged material into the well where it falls to the bottom of the hole. This is highly important since the formation face can thereby be cleaned instead of having material driven into it from a casing or liner or driven further into the formation itself. Finally, where an electrical discharge is utilized for creation of the plasma region, this provides a highly efficient system which directly converts electrical energy to shock waves.

Figure 2:
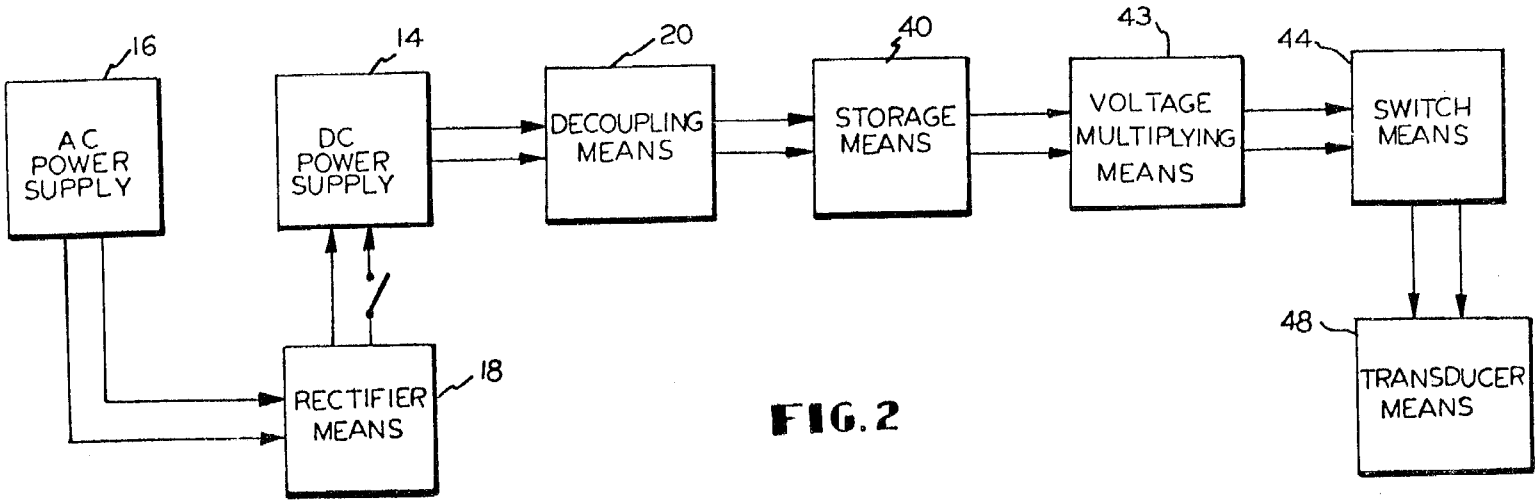
FIG. 2 is a more detailed block diagram of the system of FIG. 1.

While numerous means can be utilized for creating the plasma, as a practical matter it has been found that a high voltage, high current electrical discharge of short duration is most effective. The downhole energy may be derived from a capacitor or bank of capacitors in which the energy has been stored for subsequent discharge. The energy may also be stored downhole in an inductor. In either instance, energy is supplied from the surface as direct current or as an alternating current which is rectified downhole. Finally, alternating current may be supplied from above ground to match downhole resonant circuit frequency of the voltage multiplier if it is an LC circuit. By way of example, a plasma can be created utilizing a voltage above about 1500 V, from round electrodes of $\frac{1}{4}$ inch diameter spaced $\frac{1}{8}$ inch apart in brine. However, a practical energy source is a 25 to 100 microfarad capacitor charged to a minimum of 5,000 V up to as high as 100,000 V. A practical voltage is 7500 to 10,000 V, depending upon the rate of repetition of the discharges. In order to charge such a capacitor a standard threephase, 240 V power supply can be utilized when rectified and amplified as shown in FIG. 2. When the shock wave has been radiated from the plasma, the continued delivery of electrical energy to the plasma channel produces little, if any, additional shock energy. Therefore, there is a practical upper limit to the size of the storage capacitor needed. The current may vary anywhere from about 10,000 A up, depending upon the rate of repetition of the discharges. Currents as high as 85,000 A have been obtained with a 25,000 V power source discharged from an 8 microfarad capacitor. However, practical equipment limitation for a downhole tool will generally limit the current range and, therefore, the preferred range is between about 20,000 and 30,000 A. The duration of the electrical discharge may be as low as $\frac{1}{4}$ microsecond and the shorter the duration of the discharge the greater the effectiveness. As a practical matter, in borehole operations, the duration of the arc is between about 10 to 50 microseconds. The power source can create a single pulse or shock wave or a plurality of pulses or shock waves. For example, pulses can be created at the rate of one to four pulses a second or more or at frequencies extending into the ultrasonic region, such as, 10 to 20 KHz. Where the signal is modulated, it is possible with a 10% duty cycle to provide a 10 KW input at the surface and obtain an average power of 100 KW output downhole. Rapid repetition rates at intervals of 1 second to 1/10,000 of a second but below natural resonance can also be utilized. Repetition at natural resonance rate can be utilized to augment the mechanical effects. Electrical systems with an automatic frequency adjustment to keep them at resonant frequency may also be used. An electrical system with resonance detection and frequency adjustment at the surface can be utilized as well as an electrical system preset to operate at the desired frequency.

The electrode configuration utilized downhole can also take various forms. For example, two fixed electrodes can be centered in the borehole. Another alternative is to provide electrodes positioned near one side of the borehole with means to rotate the tool in the hole. The configuration of the electrode supporting structure is also important. It has been found that a plasma oriented parallel to the axis of the borehole, and placed at the focal point of a figure of revolution of a paraboloid (with an aperture of $1\frac{1}{2}$ to 2 inches) produces a significant focusing effect. Pressure pulses of 10,000 to 100,000 atmospheres are thus directed into a 3 to 4 inch band of the adjacent well bore with shattering effects on deposits on the surface and in the slots of a slotted liner.

The environment around the sonde in the hole may include any natural fluid in the hole, water, brine, oil, solvents, acids or other chemicals adapted to attack plugging materials and/or the formation itself. In such an instance, the gasifiable and ionizable medium in which the plasma is created, it the liquid in the hole. In order to avoid random duration of the prebreakdown period and an irregular, unpredictable path for the spark, the spark may be initiated with a fine wire between the electrodes. The type of metal does not appear significant and filaments, such as, a 3 mil copper filament of a 1 mil tungsten filament can be employed. While the use of small, closely-spaced electrodes confines the plasma to a small region, such a gasifiable and ionizable wire will result in a smaller, more compact plasma.

FIG. 1 of the drawings illustrates a basic system for producing a plasma in accordance with the present invention. In accordance with FIG. 1, a power supply 2 is provided. Generally, the power supply should have a capacity of about 1 to 100 KW. Connected to the power supply is decoupling means 4. Decoupling means 4 may be necessary in order to prevent damage to the power source during charging of the hereinafter mentioned storage means. The decoupling means can be simply a cable and a series of resistors sufficient to protect the DC supply. However, most standard power supplies already have such protection and, in any event, if the cable is long enough, it will provide suitable resistance. Connected to the decoupling means is a suitable storage means 8 and a switch means 10. The storage means 8 can take various forms such as a simple capacitor or bank of capacitors connected across the power supply by means of the decoupling means or a suitable inductor. The switch means can be any device which can be operated at the desired frequency and which is capable of handling the necessary high currents. The switch can take the form of an SCR, a Xenon filled tube of the type used to pulse ruby lasers or a triggered spark gap. Since current flow is high, the switch will normally be closely associated with the transducer means 12. The switch can also be controlled by a solenoid stepping relay which actuates a high voltage solenoid. A spark gap or transducer means 12 can be any means which can produce a high arc, preferably under a fluid environment. This can be a simple spark gap having a gap width of about 0.04 to 0.05 inch, and preferably about 0.1 inch, or a device adapted to cause a heavy current to flow through a fusible wire which can be fed continuously or intermittently into the area where the plasma is being generated. The switch means should be capable of switching at frequencies anywhere from 1 to 4 cycles each second to as high as 5 to 25 KHz.

While the power supply 2 of FIG. 1 may be located at the surface of the earth with the remaining components in the well or the power supply 2 may be located in the well, as a practical matter, the complete power supply cannot be located in either place without difficulties. For example, a power supply sufficient to provide a voltage of 5,000 volts or more generally cannot be located downhole since such a system would be entirely too bulky and requires cables which are not generally available. In ordinary oil well operations, it is necessary to work within a hole having a diameter of about 6 to 12 inches and usually in the neighborhood of 6 inches. Consequently, a power supply of the nature necessary for operation in accordance with the present invention should not be completely housed in the downhole sonde. By the same token, if the complete power supply is located at the surface of the earth, it is necessary to transmit extremely high voltages and currents down a cable supporting the downhole sonde. Under these circumstances, it is wholly impractical to build a suitable cable capable of safely and effectively transmitting the signals required. It has therefore been found preferable, in accordance with the present invention, to locate a conventional power source at the surface of the earth and to then utilize a voltage multiplier or high voltage power supply of some type downhole in order to obtain the output necessary for operation of the system. This is illustrated in FIG. 2 of the drawings. In accordance with FIG. 2, a conventional direct current supply 14 is provided at the surface of the earth. Alternatively, an alternating current supply 16, for example, a three-phase, 240 V standard power supply, may be provided at the surface of the earth and then rectified by rectifier means 18 to provide an appropriate direct current supply. Rectification can take place at the surface or downhole.

The direct current supply is connected to decoupling means 20. Decoupling means 20 serves to protect the direct current supply. Decoupling means 20 may be as simple as the cable leading from the surface to the downhole sonde with a series of resistors. The decoupling means may therefore be a variety of cables designed to transmit power down a borehole and, at the same time, support a sonde in the borehole. A typical example would be a 3 conductor cable having a double lay steel armor on its exterior for grounding the cable at the surface. Such a cable or decoupling means is illustrated in FIG. 3 of the drawings. In accordance with FIG. 3, a direct current supply 14 is connected to conductors 22 and 24, respectively. The third conductor, 26, is connected to conductor 22 through variable resistor 28. Each of the three conductors, 22, 24, and 26, are provided with appropriate resistors 30, 32 and 34, respectively. Resistors 30, 32 and 34 may, for example, be 36 ohm resistors. Surrounding the three conductors is steel armor 36 which is grounded at the surface by ground means 38. In most instances, where the cable is long, the cable resistance itself can provide sufficient resistance to accomplish this.

Storage means 40 is supplied with the signal through the decoupling means 20. Storage means 40 may be as simple as a capacitor or a bank of capacitors connected across the power supply by means of decoupling means 20. A suitable storage means 40 made up of a bank of capacitors is illustrated in FIG. 4 of the drawings. In accordance with FIG. 4, a bank of capacitors 42 is connected across the supply line from decoupling means 20. Capacitors 42 may be, for example, Cornell-Dubilier, type FAH-162-450, 1600 microfarad, electrolytic capacitors. Resistors 46 are in parallel with capacitors 42. These resistors may, for example, be 100 megohm resistors.

As previously indicated, it is not practical to transmit high voltages down a cable from the surface of the earth. Accordingly, a voltage multiplier 43 should be included in the downhole portion of the system. Such voltage multiplier may be any standard unit for this purpose. For example, a series LC resonant circuit may be used.

Figure 10:
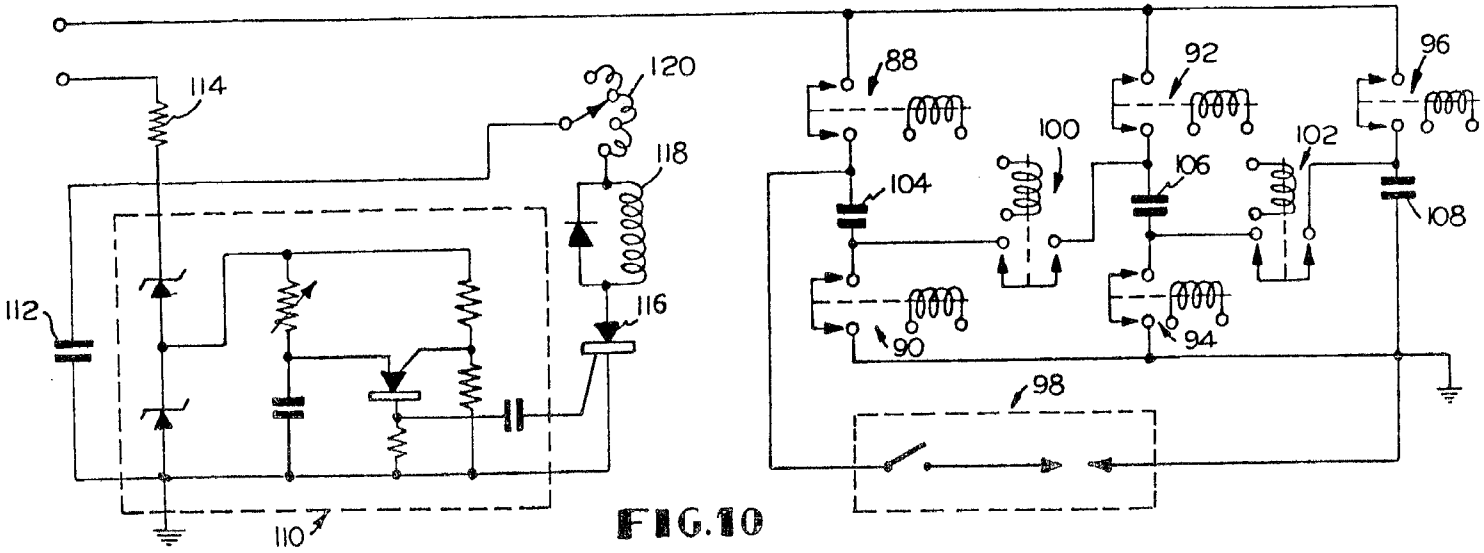
FIG. 10 is a detailed, electrical schematic of an embodiment of a switch means and transducer for use in the system of FIG. 2.

Switch means 44 of FIG. 2 can also take several forms. This switch can be any device which can be operated at the desired frequency and is capable of handling the necessary current. For example, a Xenon-filled gas discharge tube of the type used for optical excitation of a ruby laser can be utilized. The power requirements to "pump" a laser crystal are of the same order of magnitude as that required in the present system. For example, a high power Xenon flash tube Type FX56 built by Edgerton, Geruneshausen and Grier, Inc. is rated at an operating voltage of 3,000 volts, a trigger voltage of 25,000 volts and has a resistance of about 0.25 ohm and a maximum current rating of about 8,000 amperes. These tubes can be used in series or in parallel with proper design precautions in the external circuit. Another form of switching means would be a gate controlled rectifier. The solid state SCR provides adequate current rating but the high voltages to be utilized in this system may present some difficulties. A third component which may be used for switching is a triggered spark gap switching an oscillatory load as shown in FIG. 5. A typical gap operates at 10 KV and is triggered from a pulse transformer having a typical peak pulse of about 40 KV with a pulse duration of about 5 microseconds. With the ionization of a gas in the spark gap, the charge on the storage means 40 flows into the load. The triggered spark gap offers a simple and effective means of switching. In accordance with FIG. 5, a trigger means 45 operates the spark gap 47, thereby discharging the storage means through the spark gap transducer means. If a series resonant circuit is utilized as a voltage multiplier and has a resonance frequency of $f_r$ and if the switch of FIG. 5 is triggered at some multiple of $f_r$, and at the correct phase relationship, then an isolation means 20 need not be utilized. However, the use of an isolation means gives the flexibility of being able to operate the system at any frequency lower than $f_r$, or at $f_r$, because the energy stored at the maximum portion of the cycle remains after the buildup of the voltage. The reason for adjusting the actual operating frequency of oscillator 110 in FIG. 10 is to adjust the system to resonance of the particular LC voltage multiplier circuit which is used in the downhole sonde. This gives the maximum mechanical effect when the arc generates the plasma. Where the switch is a triggered spark gap, as in FIG. 5, which is triggered with a pulse as indicated, it will be self-extinguishing at reduced voltage. One configuration, suitable for the electrodes of FIG. 5 are two hemispherically-shaped metal electrodes about 2 inches in diameter and ¼ inch thick with a 1 inch diameter coin silver facing. A hole is drilled through the center of one hemisphere and a porcelain tube mounted therein. The electrode 49 then passes through the porcelain tube.

As indicated previously, the spark gap transducer means 48 may be any of a variety of means which can produce a high power arc under fluid environments. This can be a simple spark gap or a device to cause a heavy current to flow through a wire which is fed in to bridge the gap between electrodes prior to each discharge or continuously. The pair of electrodes can be 5/16 inch rounded electrodes, a single rounded electrode and a single pointed electrode or two pointed electrodes. Also, as previously stated, two fixed electrodes can be centered in the hole or two electrodes can be located near one side of the hole and means can be provided for rotating the sonde. The two electrode systems can obviously be utilized where the gasifiable and ionizable medium is liquid in the well. In addition to the fluid as a gasifiable and ionizable medium in the well, a gasifiable and ionizable metal can be utilized. In such case, the wire filament can be continuously or intermittently advanced between a pair of electrodes or alternatively, the consumable wire filament could be advanced through a hollow electrode combined with a point-type electrode. Since the electrodes themselves erode somewhat they might also be advanced or replaced each trip to the surface. Finally, in a two electrode system, the electrodes themselves could be consumable and could be fed to the point of gasification and ionization as portions of the electrodes are consumed. Several of these arrangements are illustrated in FIGS. 6 through 8 of the drawings. FIG. 6 shows a system having 2 pointed electrodes 50 and 52 with a gasifiable and ionizable wire filament 54 being advanced therebetween. The filament 54 is advanced by a motor and reel mechanism 56. FIG. 7 shows a hollow electrode 58, a pointed electrode 60 and a gasifiable and ionizable wire filament 62 being continuously advanced through the hollow electrode 58 or intermittently advanced after each discharge. The filament 62 is advanced by a motor-reel mechanism 64. In accordance with FIG. 8, 2 consumable electrodes 66 and 68 are shown and these are fed to the point of gasification and ionization as they are consumed by means of motor and reel mechanisms 70 and 72, respectively. However, heavy rods, i.e. ½ inch in diameter or more, can also be used and replaced each time the apparatus is removed from the well.

Figure 9:
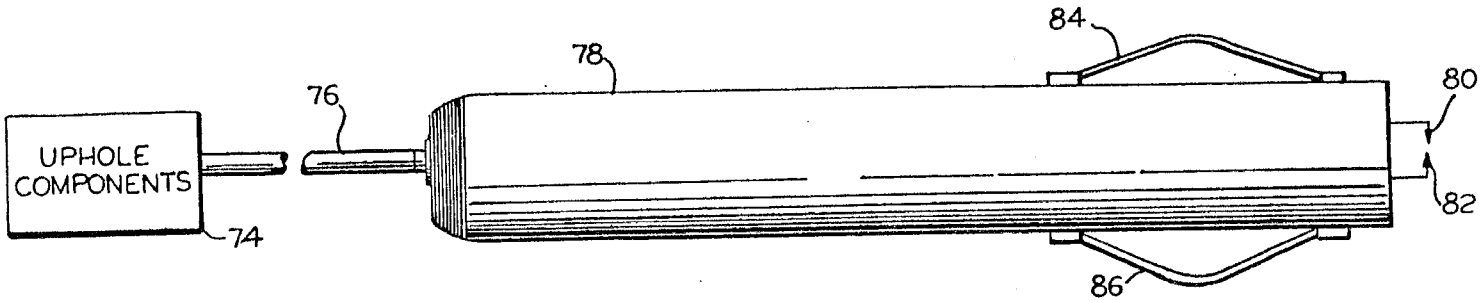
FIG. 9 is a mechanical representation of the overall system of the present invention.

FIG. 9 of the drawings shows in outline-form the overall apparatus with a surface power and control system 74, a cable 76 for supporting the sonde 78 and for transmitting power from the surface to downhole sonde 78. Located in the downhole sonde 78 are the downhole electronic components of the system with the exception of the spark gap transducer electrodes 80 and 82 which protrude from the sonde. The sonde is centralized in the borehole by means of centralizer elements 84 and 86.

Mechanical voltage multiplication and firing can be provided for the downhole tool. Such a system has numerous advantages. First, it lowers the voltage which must be transmitted down the cable. Secondly, it is simple since there is a minimum of downhole electronics to lead to problems. Thirdly, it can be run on a single conductor wire line. The power supply can be a high voltage DC with superimposed AC or a downhole stepping relay circuit. Such a system is illustrated in FIG. 10 of the drawings. In accordance with FIG. 10, the sequence of operation would be as follows: Relay 88 and relay 90 are energized to charge capacitor 104 and then released. Thereafter, relay 92 and relay 94 are energized to charge capacitor 106 and released. Relay 96 is then energized to charge capacitor 108 and released. Relays 100 and 102 are energized to connect capacitors 104, 106 and 108 in series. After a time delay of about 50 milliseconds, to permit stabilization, the triggered spark gap 98 is fired. The cycle is then repeated. Relays 88 to 96, 100 and 102 are preferably Magnicraft WS99B relays rated at 50 A and 10,000 V. The basic operational features are that the plasma is generated by capacitors 104, 106 and 108, charged in parallel and discharge in series through triggered spark gap 98. Secondly, the control circuit or oscillator 110 is powered from a single high voltage source. Capacitor 112 is charged through resistor 114. Resistor 114 would be rated at 100 megohms. As the charge on capacitor 112 builds up, unijunction oxcillator 110 fires (adjustable frequency 1 to 1/10 pulses per second). SRC 116 fires and solenoid 118 is energized. SRC 116 is turned off during the dead time of the switch. The cycle is then repeated upon generation of another pulse from oscillator 110. The relays may be switched by switch 120 mounted on a rotary solenoid shaft.

It is to be understood, that although specific examples and illustrations appear herein, other variations and modifications will be apparent to one skilled in the art. Accordingly, the present invention is to be limited only in accordance with the appended claims.

We claim:

1. Apparatus for descaling a borehole casing comprising:

a. a sonde for being lowered into said borehole,
b. a cable coupled to said sonde for raising and lowering said sonde in said borehole,
c. a low voltage source located external of said borehole,
d. a voltage multiplier interconnected with and adapted to travel into and out of said borehole with said sonde,
e. a first electrical circuit within said cable for connecting said low voltage source to said voltage multiplier,
f. arc means attached to said sonde for gasifying and ionizing a medium in said borehole whenever a high voltage arc is generated thereby creating a plasma which generates an initial shockwave in said medium to loosen scales of material followed by a rarefactionwave which forces loosened scale material back into the borehole where it falls to the bottom, and
g. means coupling said voltage multiplier to said arc means at predetermined intervals to generate said high voltage arc.

2. Apparatus as in claim 1 wherein said voltage multiplier is an LC circuit.

3. Apparatus as in claim 2 wherein said predetermined interval is:
a. between 1 and $1\times10^{-4}$ seconds, and
b. is a multiple of but below the resonant frequency of said LC circuit.

4. Apparatus as in claim 2 wherein said low voltage source comprises an AC voltage source.

5. Apparatus as in claim 4 further including a rectifier circuit in said sonde coupled to said AC source for converting said AC voltage to a DC voltage.

6. Apparatus as in claim 4 wherein said AC voltage further includes a frequency which matches the resonant frequency of said LC circuit.

7. Apparatus as in claim 1 wherein the voltage multiplier comprises:
a. means for storing a voltage on capacitors in parallel, and
b. means for discharging said capacitors in series.

8. Apparatus as in claim 1 wherein said low voltage source comprises a DC source.

9. Apparatus as in claim 1 wherein said arc means comprises a pair of fixed electrodes centered in said borehole.

10. Apparatus as in claim 1 wherein said arc means comprises:
a. one hollow electrode,
b. one point electrode, and
c. means for advancing a gasifiable and ionizable wire between said electrodes.

11. Apparatus as in claim 1 wherein said arc means comprises:
a. a pair of gasifiable and ionizable electrodes, and
b. means for advancing said electrodes as said electrodes are consumed by electrical arcing.

12. Apparatus as in claim 1 further comprising:
a. means positioning said arc means near one side of said borehole, and
b. means for rotating said arc means in said borehole.

13. Apparatus as in claim 1 further including means for repetitively energizing said arc means at intervals between about 1 and 4 times per second.

14. Apparatus for descaling a borehole casing comprising:
a. a sonde for containing electronic and mechanical equipment used in a borehole for descaling purposes,
b. a cable coupled to said sonde for raising and lowering said sonde in said borehole,
c. a low voltage power supply located externally of said borehole,
d. a voltage multiplier circuit located on said sonde comprising:
i. a plurality of capacitors,
ii. relays coupled to said power supply and said capacitors for storing a voltage on said capacitors in parallel and discharging said capacitors in series,
iii. a stepping switch for sequentially operating said relays to store said voltage on said capacitors in parallel and to discharge said capacitors in series thereby generating a high voltage,
iv. a silicon controlled rectifier switch for operating said stepping switch, and
v. an oscillator coupled to said silicon controlled rectifier switch for intermittently firing said silicon controlled rectifier switch to cause said stepping switch to step sequentially thereby operating said relays to charge said capacitors in series and discharge said capacitors in parallel at a frequency determined by said oscillator.
e. high voltage arc generating means connected to said sonde for gasifying and ionizing a medium in said borehole whenever a high voltage arc is generated thereby creating a plasma which generates an initial shockwave in said medium to loosen scales of material followed by a rarefaction wave which forces loosened scale material back into the borehole where it falls to the bottom, and
f. means coupling said intermittently generated high voltage to said arc generating means to generate said high voltage arc.

15. Apparatus for descaling a borehole casing comprising:
a. a sonde for containing electronic and mechanical equipment used in a borehole for descaling purposes,
b. a cable coupled to said sonde for raising and lowering said sonde in said borehole,
c. a low voltage power supply located externally of said borehole,
d. a voltage multiplier circuit located on said sonde comprising:
i. a plurality of capacitors,
ii. relays coupled to said power supply and said capacitors for storing a voltage on said capacitors in parallel and discharging said capacitors in series,
iii. a stepping switch for sequentially operating said relays to store said voltage on said capacitors in parallel and to discharge said capacitors in series thereby generating a high voltage,
iv. a silicon controlled rectifier switch for operating said stepping switch, and
v. an oscillator coupled to said silicon controlled rectifier switch for intermittently firing said silicon controlled rectifier switch to cause said stepping switch to step sequentially thereby operating said relays to charge said capacitors in series and discharge said capacitors in parallel at a frequency determined by said oscillator.
e. arc means including one hollow electrode, one point electrode and means for continuously advancing a gasifiable and ionizable wire between said electrodes, and
f. means coupling said intermittently generated high voltage to said arc means to generate said plasma by intermittently gasifying and ionizing said continuously advancing wire.

* * * * *